US009314091B2

(12) United States Patent
Schulz

(10) Patent No.: US 9,314,091 B2
(45) Date of Patent: Apr. 19, 2016

(54) METHOD AND APPARATUS TO STORE AND ACCESS TOOLS DIRECTLY TO THE PALM

(71) Applicant: Steven Mark Schulz, Baton Rouge, LA (US)

(72) Inventor: Steven Mark Schulz, Baton Rouge, LA (US)

( * ) Notice: Subject to any disclaimer, the term of this patent is extended or adjusted under 35 U.S.C. 154(b) by 9 days.

(21) Appl. No.: 14/169,054

(22) Filed: Jan. 30, 2014

(65) Prior Publication Data

US 2015/0208793 A1 Jul. 30, 2015

(51) Int. Cl.
*A45F 5/00* (2006.01)
*B25H 3/00* (2006.01)

(52) U.S. Cl.
CPC .. *A45F 5/00* (2013.01); *B25H 3/00* (2013.01); *A45F 2005/008* (2013.01); *A45F 2200/0575* (2013.01)

(58) Field of Classification Search
USPC ..... 224/183, 219, 222, 267, 196, 197, 217, 224/218, 904, 908, 930; 294/25; 401/8; 2/160; D14/427
See application file for complete search history.

(56) References Cited

U.S. PATENT DOCUMENTS 1,274,312 A 7/1918 Nicoli
3,060,625 A * 10/1962 Glass et al. ..... 224/267
4,040,547 A * 8/1977 Dickey ..... F16M 13/04 224/247
4,214,688 A * 7/1980 Griffin, Jr. ..... A45F 5/00 224/197
4,253,134 A 2/1981 Barnaby
4,425,600 A 1/1984 Barnhart
4,613,179 A * 9/1986 van Zelm ..... B25J 1/02 294/111
4,826,059 A 5/1989 Bosch et al.
5,082,156 A 1/1992 Braun
5,103,384 A 4/1992 Drohan
5,183,193 A 2/1993 Brandell
5,195,667 A * 3/1993 Gallant ..... A45F 5/02 224/197
5,201,444 A 4/1993 Simonet
5,213,240 A 5/1993 Dietz et al.
5,228,610 A 7/1993 Spence
5,257,729 A 11/1993 Silvernail
5,261,581 A * 11/1993 Harden, Sr. ..... 224/219
5,544,420 A 8/1996 Choi
5,601,356 A 2/1997 McWilliams
5,785,217 A 7/1998 Gerham, Jr.
5,797,670 A 8/1998 Snoke et al.
5,894,971 A 4/1999 Huang
5,944,242 A * 8/1999 Musarella ..... A45F 5/02 224/270
6,038,743 A 3/2000 Chapman
6,113,565 A 9/2000 Schlup et al.
6,173,451 B1 1/2001 Devincenzi
6,216,319 B1 4/2001 Elkins
6,325,577 B1 * 12/2001 Anderson ..... A45F 5/02 206/350
6,360,928 B1 3/2002 Russo
6,487,756 B1 12/2002 Vidal, Jr.
6,508,390 B1 * 1/2003 Karpati ..... A45F 5/00 224/200
6,535,605 B1 3/2003 Ghassabian (Continued)

FOREIGN PATENT DOCUMENTS

WO WO-2004/039204 A1 * 5/2004 ..... A45F 5/00

*Primary Examiner* — Gary Elkins
(74) *Attorney, Agent, or Firm* — John B. Edel; Edel Patents LLC

(57) ABSTRACT

A wrist attachable device comprising an arm that can articulate. The arm is fastened to the wrist collar in a parallel axis with the wrist. This arm is designed with means to mount a tool or a measuring tape. The arm is designed to swing the attached tool into the palm of the hand attached to the arm band. Upon completion of the tool use, the arm is designed to return the tool to a home position further back on the wrist against the cuff and out of the way.

18 Claims, 3 Drawing Sheets

(56) References Cited

U.S. PATENT DOCUMENTS

| | | | | |
|---|---|---|---|---|
| 6,557,738 | B1 * | 5/2003 | Meintzer | B44D 3/14 224/148.7 |
| 6,796,467 | B2 * | 9/2004 | Caldana | 224/219 |
| 7,314,153 | B2 * | 1/2008 | Musarella | A45F 5/02 224/247 |
| 7,996,922 | B2 | 8/2011 | Ross et al. | |
| 8,028,872 | B2 * | 10/2011 | Hamlin | 224/183 |
| 8,061,340 | B2 | 11/2011 | Mitchell et al. | |
| 8,146,785 | B2 | 4/2012 | Pruitt | |
| 8,210,406 | B2 | 7/2012 | Moreau et al. | |
| 8,245,892 | B2 * | 8/2012 | Kriner | 224/163 |
| 8,317,242 | B2 | 11/2012 | Yu | |
| 2006/0054647 | A1 * | 3/2006 | Kathrein et al. | 224/183 |
| 2011/0303710 | A1 * | 12/2011 | Yu | 224/219 |

* cited by examiner

METHOD AND APPARATUS TO STORE AND ACCESS TOOLS DIRECTLY TO THE PALM

REFERENCE CITED

U.S. Patent Documents

| | | | |
|---|---|---|---|
| 1,274,312 | July 1981 | Nicoli | 244/222 |
| 4,253,134 | February 1981 | Barnaby | 362/120 |
| 4,425,600 | January 1984 | Barnhart | 362/103 |
| 4,826,059 | May 1989 | Bosch et al. | 224/904 |
| 5,082,156 | January 1992 | Braun | 224/267 |
| 5,103,384 | April 1992 | Drohan | 362/191 |
| 5,183,193 | February 1993 | Brandell | 224/219 |
| 5,201,444 | April 1993 | Simonet | 224/183 |
| 5,213,240 | March 1993 | Dietz et al. | 224/183 |
| 5,257,729 | November 1993 | Silvernail | 224/219 |
| 5,544,420 | August 1996 | Choi | 362/120 |
| 5,601,356 | February 1997 | McWilliams | 362/103 |
| 5,785,217 | July 1998 | Gerham Jr | 223/111 |
| 5,278,610 | July 1993 | Spence | 224/267 |
| 5,797,670 | August 1998 | Snoke et al. | 362/191 |
| 5,894,971 | April 1999 | Huang | 224/218 |
| 6,038,743 | March 2000 | Chapman | 24/3.2 |
| 6,113,565 | September 2000 | Schlup et al. | 602/62 |
| 6,173,451 | January 2001 | DeVincenzi | 2/162 |
| 6,216,319 | April 2001 | Elkins | 24/3.2 |
| 6,360,928 | March 2002 | Russo | 224/218 |
| 6,487,756 | December 2002 | Vidal, Jr. | 24/3.1 |
| 6,535,605 | March 2003 | Ghassabian | 379/433.1 |
| 7,996,922 | August 2011 | Ross et all | 2/170 |
| 8,061,340 | November 2011 | Mitchell et al. | 124/35.2 |
| 8,146,785 | April 2012 | Pruitt | 224/219 |
| 8,210,406 | July 2012 | Moreau et al. | 224/221 |
| 8,317,242 | November 2012 | Yu | 294/25 |

BACKGROUND OF THE INVENTION

1. Field of the Invention

The invention relates generally to a tool holding mechanism designed to reduce misplacing actively used devices such as tape measuring devices. Further the tool manipulator is designed to create instant access to the tape measure in this case.

2. Description of Prior Art

There is a need to organize and access instruments and tools in every profession. This need has led to many developments in the field of tool holders. Most developed tool holders use static means to keep tools on hand and within reach. This has taken the form of pockets and holsters designed for various tools such as tape measures. In addition there are various hooks and clips that have been designed to attach and suspend tools within easy reach.

Another approach has been to fasten these hooks and pockets to various articles of apparel so they can be worn while the worker needs access to the tools. There have been some developed wrist devices that are designed to hold tools in various configurations; U.S. Pat. No. 5,904,280 by Chan is an example of a wrist mounted tool holder. In Chan's device the object is to create a platform useful for small parts and provisions for a tape measure that is incorporated in the device. The drawback of this design from the tape measure's perspective is the ability of the user to have the freedom to use the tape measure while it is awkwardly attached to the wrist. Additionally, this device has provisions for various other attachments that become a detriment when working on a job site and require the use of both hands while engaged in said work while encumbered with a bulky wrist attachment festooned with parts and devices.

This invention differentiates itself from the typical wrist devices by utilizing an articulating arm designed to hold an important instrument or tool. Its design is centered around the need to access the tools often and quickly, such as a tape measure. In addition, the invention is designed to place the tool along the wrist away from the hand so as to allow the articulation of the worker's hand and stay out of the way while work is performed. When the need arises to use the tool or in this case the tape measure all that is needed is to flip the attached arm to an open position and this rotates the arm with the attached tool into the palm of the worker for use in the field. There have been other inventions that rely on articulated members attached to the wrist, Pyle in invention U.S. Pat. No. 8,016,492 B2. This invention relates to a hinged means for stabilizing a camera and has no means for quick access to place anything in the palm of a user. This invention is inherently unsuited to provide any tool handling assistance and is essentially a portable tripod. Ghassabian in invention U.S. Pat. No. 6,535,605 has incorporated an articulating member in the scope of his wrist mounted phone. This invention relates to the ability of someone manipulating a keyboard device through various attachments, Ghassabians device has no means to carry tools or an intent to manipulate an attached tool. In Vidal, Juniors device, U.S. Pat. No. 6,487,756 a lanyard is attached to a spring loaded take up reel that is capable of holding tools. This arrangement has the primary drawback of not holding a tool in a secure and immobilized position, further this device has no means to direct a tool into the palm consistently.

The removable connecting strap of Mitchell et all U.S. Pat. No. 8,061,340 is another apparatus that incorporates a movable arm and this is designed to attach to an arrow to multiply the force needed to draw a bow string to its full travel before releasing it prematurely. The scope of this invention is limited to the field of archery and it is not equipped to swing along the axis of the arm while holding a tool. Braun in U.S. Pat. No. 5,082,156 has claimed a strap for holding a tool through a lanyard arrangement to the arm or wrist. This device is limited in its lack of ability to keep this attached tool from bumping and hindering the user when the tool is not being used, furthermore it has no provision to secure the tool out of the way until needed. It also lacks any provisions to deliver this tool to the palm in a consistent manner. There are several inventions that use magnetic means to secure tools and parts in proximity to the worker. Dietz et all in U.S. Pat. No. 5,213,240 is one such device and utilizes a magnet to secure a tool such as a measuring tape to a magnetic device. This device has no provision to swing this tool and place it in the palm of the worker and no means to articulate the device once fastened to the worker other than simple rotation of the measuring tape.

BRIEF SUMMARY OF THE INVENTION

This is a device that is designed to attach to a wrist through various means, such as a stretched fabric with Velcro style friction segment. Other styles of wrist attachment are common such as straps that have a mechanical buckle or snug fitting bands such that will stretch around the wrist. The preferred method of wrist attachment is a wide fabric that is designed to encircle the wrist and latch on securely with Velcro style means. This is only a preferred technique and there are many attachment strategies that could be employed and they are within the scope of this invention. The heart of the device is the ability to attach a tape measure or other instrument to an articulating arm and have the ability to swing that arm to a staging section located along the wrist band.

It is this ability that is unique and it is this function we have developed to give workers the ability to have a tool literally within arm's reach, yet not hindering the ability of the worker to perform work tasks. The ability to rotate a tool out of the work path is provided through the use of a ridged or semi ridged articulating arm. This can be a fabric or a plastic or a metal arm. In our preferred design the use of a ridged arm is detailed in the description of the invention, but anyone with experience in the art could fashion an arm of various materials that would work and would be considered covered in our design.

In addition the wrist attachment has means to fasten the arm so that it will articulate along the preferred axis and be repeatable. This can occur through the use of various hinge arrangements such as metal pinned hinges, or plastic pinned or molded and incorporated hinge segments. The described arrangement listed in the description section lists a pinned hinge in our preferred arrangement. Further means is needed to affect the arm and secure it to the wrist segment when not needed. In our preferred arrangement the use of a magnet is the means to secure the arm to the wrist segment. There are other means that are possible and various friction style arrangements, such as Velcro will accomplish this and should not be viewed as out of the scope of this invention. This invention provides a unique arrangement to allow immediate access without hindering the user while the tool is not needed. In our preferred design the tape measure or tool uses a male adapter to attach to the swing arm. This arrangement allows the user to snap the tool in place quickly and have the ability to remove the tool just as easily for use in an unrestricted environment. The swing arm can be rotated back to the home position while the tool is used and then the tool can be easily re-attached to the swing arm.

DETAILED DESCRIPTION OF PREFERRED EMBODIMENT

Figure 1:
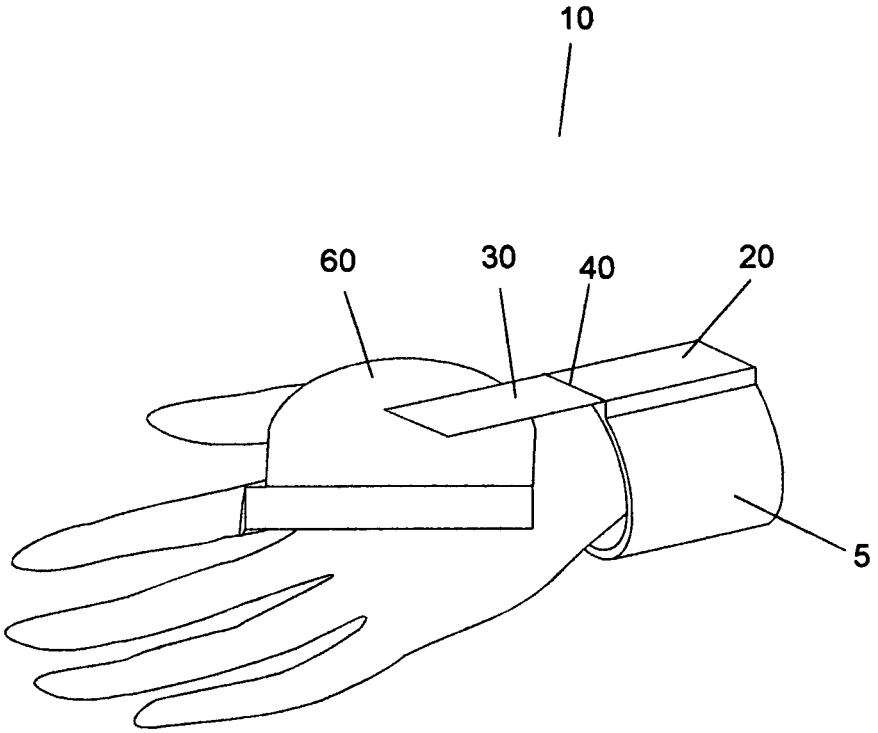
FIG. 1 Is a three dimensional simplified representation of the invention in an open configuration with a tape measure attached and shown in place on a wrist.
Figure 2:
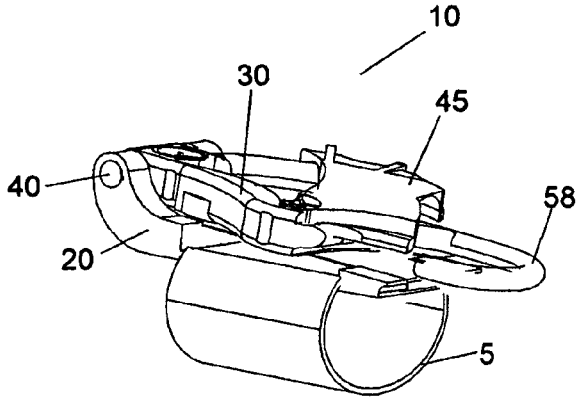
FIG. 2 Is a three dimensional representation of the invention in an closed configuration.

Referring to the drawings, there is shown a wrist mountable device 10 for carrying and utilizing tools that embodies the invention. In FIG. 1 through FIG. 6 the wrist strap 5 can be of a hook and loop fastening system or use an arrangement of buckles or expandable fabric as mating means (not shown) as is known in the art. The body of the device is shown as body segment 20 and is affixed to the wrist strap 5 though a friction arrangement or glued to body segment 20. The body segment 20 acts as the fulcrum of hinge 40 and the effective home position of swing arm 30 when in the home or closed position which is shown in FIG. 2. The body segment 20 has some ferrous metal 25 attached, shown in FIG. 3, FIG. 4, and FIG. 6, that acts as an attachment point for the swing arm 30 to affix to when the proximity of this arm comes within reach of the magnet 50. It is this attraction between the magnet 50 and the metal 25 component of the body segment 20 that creates a secure home position for the swing arm 30 to come to rest with a tool 60 attached like the one shown in FIG. 5.

Figure 3:
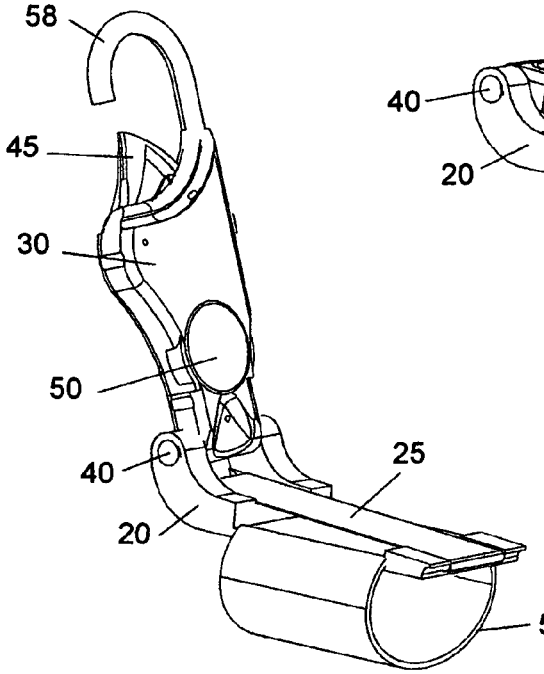
FIG. 3 Is a three dimensional representation of the invention with the arm in halfway open configuration.
Figure 4:
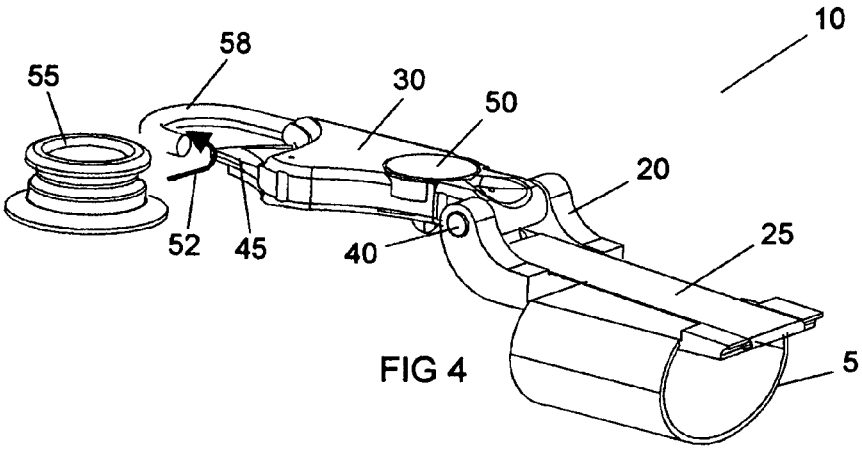
FIG. 4 Is a three dimensional representation of the invention in an open configuration and showing a male adapter designed to attach to a tool.

The body segment 20 utilizes a hinge 40 that is affixed to both the arm 30 and the segment 20 and comprises a hinge mechanism that utilizes a pin 40 through rotatable members as shown in our preferred embodiment. As shown in FIG. 3 and FIG. 4 as the swing arm 30 rotates through the travel of the swing the hook style attachment means 58 is designed to secure and align the tool through male members 55 as shown in FIG. 4. The ability to use a release 45 as depicted in FIG. 4 allows the user to remove and access the tool unrestricted when needed, then replace the tool easily as indicated by the directional arrow enumerated by 52. Various hinge arrangements will work for this application, it can be created as a living hinge affected by the material used in either the arm 30 section or the fixed body segment 20 allowing the arm 30 to swing as depicted in FIG. 1. A pin is in our preferred embodiment but many hinge arrangements are known in the art and will be construed as covered by this invention.

Figure 5:
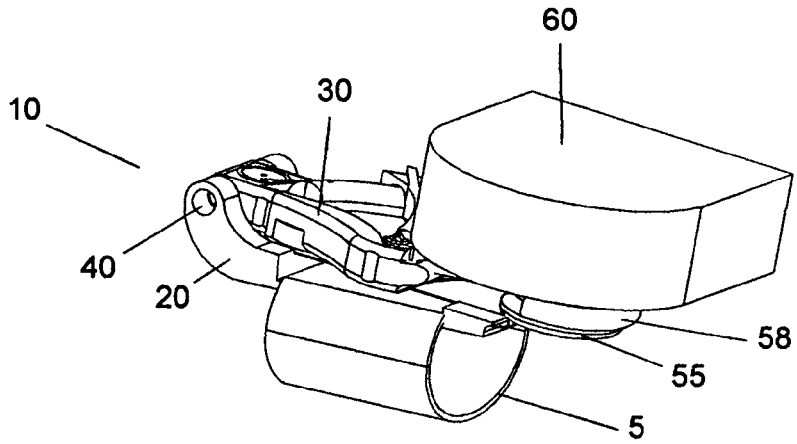
FIG. 5 Is a three dimensional representation of the invention in an closed configuration with a tape measure attached.
Figure 6:
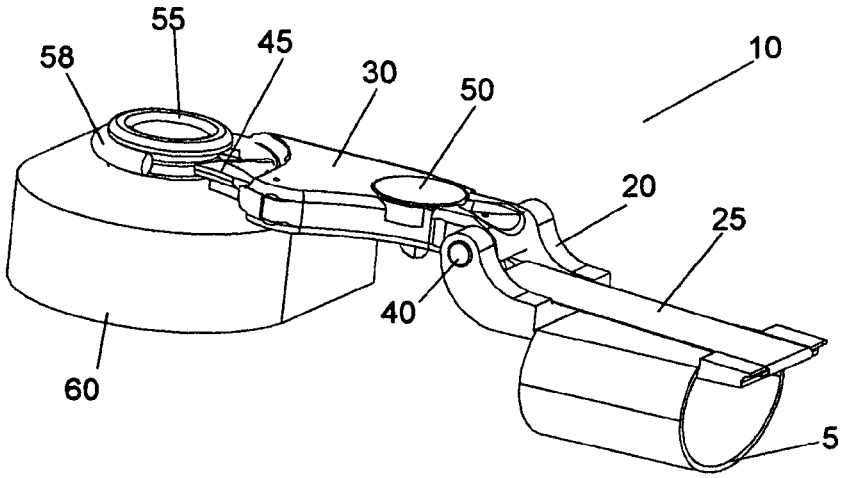
FIG. 6 Is a three dimensional representation of the invention in an open configuration with a tape measure attached.

In drawing FIG. 5 and FIG. 6 the measuring tool 60 is attached via the male mating member 55 that is clasped in place within the attachment mechanism depicted by loop 58 and secured by release 45 in our preferred embodiment. The male member 55 can be glued or mechanically affixed to the tape measure 60 or any other tool desired. Alternative clamp or friction mechanisms can be used to fasten the tool against the end of the swing arm 30 so it is available for use in the palm when needed. Many arrangements are known in the art that will affix a tool to the swing arm and will be construed as covered by this invention. The swing arm 30 has provisions to latch onto the metal segment 25 within the body segment 20 when the swing arm 30 is in proximity or in a closed position as indicated in FIG. 2 or FIG. 5. This attachment method can utilize a magnet 50 or a friction device to affect this temporary attachment to the body segment 20. The invention relies on the proper degree of attraction of the swing arm 30 to the home position and this should be just enough to hold the arm and tool in place while the tool is not needed without swinging loose prematurely and becoming a nuisance to the operator.

The swing arm 30 can be constructed using a stiff or ridged member or it can utilize various fabric or flexible designs and should have the ability to be easily dislodged from this home position when the need arises to utilize the tool and have it swing into the user's palm for use.

It is understood that the present invention is not limited to the embodiments described above, but encompasses any and all embodiments within the scope of the following claims.

I claim:

1. A tool access device comprising:

a. a body segment;

b. a strap attached to the body segment;

c. a hinge at one end of the body segment;

d. a swing arm attached to the body segment at the hinge;

e. a hook attached to the swing arm opposite the hinge;

f. a male member; and g. a tool;

h. wherein the male member is affixed to the tool;

i. wherein the male member is removably secured within the hook; and j. wherein a releasable lock secures the male member within the hook.

2. The tool access device of claim 1 wherein the swing arm is arranged and configured to magnetically secure to the body segment.

3. The tool access device of claim 1 wherein the releasable lock pivots and the releasable lock is adjacent to the hook.

4. The tool access device of claim 1 wherein the swing arm contains a magnet.

5. The tool access device of claim 1 wherein the strap is sized and configured to surround a wrist.

6. The tool access device of claim 1 wherein the tool is a tape measure.

7. The tool access device of claim 1 wherein the hook is metal.

8. The tool access device of claim 1 wherein the swing arm is a rigid component.

9. The tool access device of claim 1 wherein the swing arm is arranged and configured to rotate about the hinge between a closed position in which the swing arm is adjacent to the body segment and an open position in which the swing arm is opposite the body segment relative to the hinge.

10. The tool access device of claim 1 a. wherein the swing arm is arranged and configured to magnetically secure to the body segment;

b. wherein the releasable lock pivots and the releasable lock is adjacent to the hook;

c. wherein the swing arm contains a magnet;

d. wherein the strap is sized and configured to surround a wrist;

e. wherein the tool is a tape measure;

f. wherein the hook is metal;

g. wherein the swing arm is a rigid component; and h. wherein the swing arm is arranged and configured to rotate about the hinge between a closed position in which the swing arm is adjacent to the body segment and an open position in which the swing arm is opposite the body segment relative to the hinge.

11. A tool access device comprising:

a. a body segment;

b. a strap attached to the body segment;

c. a hinge at one end of the body segment;

d. a swing arm attached to the body segment at the hinge;

e. a hook attached to the swing arm opposite the hinge;

f. a male member; and g. a tool;

h. wherein the male member is affixed to the tool;

i. wherein the male member is removably secured within the hook; and j. wherein the tool is a tape measure.

12. The tool access device of claim 11 wherein the swing arm is arranged and configured to magnetically secure to the body segment.

13. The tool access device of claim 11 wherein the swing arm contains a magnet.

14. The tool access device of claim 11 wherein the strap is sized and configured to surround a wrist.

15. The tool access device of claim 11 wherein the tool is a tape measure.

16. The tool access device of claim 11 wherein the hook is metal.

17. The tool access device of claim 11 wherein the swing arm is a rigid component.

18. The tool access device of claim 11 wherein the swing arm is arranged and configured to rotate about the hinge between a closed position in which the swing arm is adjacent to the body segment and an open position in which the swing arm is opposite the body segment relative to the hinge.

* * * * *